US008776293B2

(12) United States Patent
Chaffee

(10) Patent No.: US 8,776,293 B2
(45) **Date of Patent: *Jul. 15, 2014**

(54) PUMP WITH AXIAL CONDUIT

(76) Inventor: Robert B. Chaffee, Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,271

(22) Filed: Aug. 8, 2011

(65) Prior Publication Data

US 2011/0293438 A1 Dec. 1, 2011

Related U.S. Application Data

(63) Continuation of application No. 11/339,025, filed on Jan. 25, 2006, now Pat. No. 8,016,572, which is a continuation of application No. 10/113,836, filed on Apr. 1, 2002, now Pat. No. 7,025,576, which is a continuation-in-part of application No. 09/859,706, filed on May 17, 2001, now Pat. No. 7,039,972, and a continuation-in-part of application No. PCT/US01/15834, filed on May 17, 2001.

(60) Provisional application No. 60/280,040, filed on Mar. 30, 2001, provisional application No. 60/280,257, filed on Mar. 30, 2001.

(51) Int. Cl.
*A47C 27/08* (2006.01)

(52) U.S. Cl.
USPC ..... 5/655.3; 417/366; 417/423.15

(58) Field of Classification Search
USPC ..... 417/366, 423.14, 423.7, 423.15, 423.1; 5/655.3
See application file for complete search history.

(56) References Cited

U.S. PATENT DOCUMENTS

| | | | |
|---|---|---|---|
| 625,114 | A | 5/1899 | MacSpadden |
| 633,968 | A | 9/1899 | Swartzwelder |
| 679,519 | A | 7/1901 | Smith |
| 827,823 | A | 8/1906 | Starr |
| 847,758 | A | 3/1907 | Frye |
| 1,185,684 | A | 6/1916 | Kraft et al. |
| 1,263,599 | A | 4/1918 | Poole |
| 1,361,453 | A | 12/1920 | Frey |
| 1,451,136 | A | 4/1923 | Allnut |
| 2,028,060 | A | 1/1936 | Gilbert |
| 2,064,695 | A | 12/1936 | Sipe |

(Continued)

FOREIGN PATENT DOCUMENTS

| | | | |
|---|---|---|---|
| CN | 2037006 | U | 5/1989 |
| CN | 1274266 | A | 11/2000 |

(Continued)

OTHER PUBLICATIONS

An English translation of a First Notification of Office Action from the Intellectual Property Office of the People's of China, mailed Aug. 6,2004.

(Continued)

*Primary Examiner* — Charles Freay
(74) *Attorney, Agent, or Firm* — Lando & Anastasi, LLP

(57) ABSTRACT

In one aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing, and a plurality of vanes are positioned within the air conduit.

19 Claims, 6 Drawing Sheets

(56) References Cited

U.S. PATENT DOCUMENTS 2,112,641 A 3/1938 Wheaton
2,168,774 A 8/1939 Hurlburt
2,285,324 A 6/1942 Bennett
2,288,889 A 7/1942 Costello
2,456,689 A 12/1948 Dickey et al.
2,482,198 A 9/1949 Melichar
2,565,406 A 8/1951 Popovich
2,701,579 A 2/1955 Hasselquist
2,767,735 A 10/1956 Darling
2,803,527 A 8/1957 Lundahl
2,823,668 A 2/1958 Van Court et al.
2,949,927 A 8/1960 Mackal
2,990,070 A 6/1961 Cushman
3,026,909 A 3/1962 Boteler
3,068,494 A 12/1962 Pinkwater
3,086,698 A 4/1963 Goldstein
3,095,901 A 7/1963 Larson et al.
3,099,386 A 7/1963 Pieper
3,112,502 A 12/1963 Forsburg
3,123,336 A 3/1964 Price
3,142,850 A 8/1964 De Boer
3,164,151 A 1/1965 Nicoll
3,208,721 A 9/1965 McHugh
3,367,819 A 2/1968 Schlag
3,403,696 A 10/1968 Pynchon
3,424,151 A 1/1969 Ericson
3,459,363 A 8/1969 Miller
3,462,775 A 8/1969 Markwitz et al.
3,505,695 A 4/1970 Bishaf et al.
3,511,472 A 5/1970 Zimmerman
3,561,435 A 2/1971 Nicholson
3,563,676 A 2/1971 Coovert et al.
3,610,235 A 10/1971 Sivash
3,665,958 A 5/1972 Dunkelis
3,667,075 A 6/1972 Ballard et al.
3,667,625 A 6/1972 Lucas
3,719,401 A 3/1973 Peruglia
3,755,832 A 9/1973 Bennett
3,762,404 A 10/1973 Sakita
3,772,717 A 11/1973 Yuen et al.
3,785,395 A 1/1974 Andreasson
3,829,918 A 8/1974 Stamberger
3,831,628 A 8/1974 Kintner et al.
3,898,703 A 8/1975 Stamberger
3,899,797 A 8/1975 Gunst
3,995,653 A 12/1976 Mackal et al.
4,068,334 A 1/1978 Randall
4,080,105 A 3/1978 Connell
4,146,069 A 3/1979 Angarola et al.
4,146,070 A 3/1979 Angarola et al.
4,168,063 A 9/1979 Rowland
4,175,297 A 11/1979 Robbins et al.
4,213,745 A 7/1980 Roberts
4,225,989 A 10/1980 Corbett et al.
4,266,298 A 5/1981 Graziano
4,273,310 A 6/1981 Ginzler
4,300,759 A 11/1981 Caplan
4,317,244 A 3/1982 Balfour-Richie
4,521,166 A 6/1985 Phillips
4,594,743 A 6/1986 Owen et al.
4,678,014 A * 7/1987 Owen et al. ..... 141/67
4,678,410 A 7/1987 Kullen
4,692,091 A 9/1987 Ritenour
4,711,275 A 12/1987 Ford et al.
4,734,017 A 3/1988 Levin
4,768,247 A 9/1988 Beier
4,829,616 A 5/1989 Walker
4,862,533 A 9/1989 Adams, III
4,890,344 A 1/1990 Walker
4,891,855 A 1/1990 Cheng-Chung
4,897,890 A 2/1990 Walker
4,911,405 A 3/1990 Weissgerber
4,948,092 A 8/1990 Kasper et al.
4,977,633 A 12/1990 Chaffee
4,982,466 A 1/1991 Higgins et al.
4,986,738 A 1/1991 Kawasaki et al.
4,990,060 A 2/1991 Cheng-Chung
5,025,894 A 6/1991 Yamasaki
5,037,062 A 8/1991 Neuhaus
5,040,555 A 8/1991 Wang
5,051,060 A 9/1991 Fleischmann et al.
5,052,894 A 10/1991 Rimington
5,060,324 A 10/1991 Marinberg et al.
5,068,933 A 12/1991 Sexton
5,071,378 A 12/1991 Wang
5,085,214 A 2/1992 Barrett
5,102,365 A 4/1992 Wang
D328,324 S 7/1992 Wang
5,144,708 A 9/1992 Pekar
5,170,522 A 12/1992 Walker
5,178,523 A 1/1993 Cheng-Chung
5,186,667 A 2/1993 Wang
5,203,808 A 4/1993 Ide
5,216,769 A 6/1993 Eakin
5,249,319 A 10/1993 Higgs
D341,983 S 12/1993 Wang
5,267,363 A 12/1993 Chaffee
5,288,286 A 2/1994 Davis
5,367,726 A * 11/1994 Chaffee ..... 5/706
5,406,661 A 4/1995 Pekar
5,450,858 A 9/1995 Zablotsky et al.
5,474,361 A 12/1995 Hwang et al.
5,491,854 A 2/1996 Music
5,494,258 A 2/1996 Weissgerber et al.
5,494,418 A 2/1996 Moriya et al.
5,503,618 A 4/1996 Rey
5,511,942 A * 4/1996 Meier ..... 415/220
5,535,849 A 7/1996 Few
5,581,304 A 12/1996 Wang
5,588,811 A 12/1996 Price
5,598,593 A 2/1997 Wolfe
5,606,756 A 3/1997 Price
5,652,484 A 7/1997 Shafer et al.
5,727,270 A 3/1998 Cope et al.
5,746,873 A 5/1998 Graf
5,839,139 A 11/1998 Fink
5,857,841 A 1/1999 Kobayashi et al.
5,890,882 A 4/1999 Feldman
5,893,609 A 4/1999 Schmidt
5,903,941 A 5/1999 Shafer et al.
5,904,172 A 5/1999 Gifft et al.
5,941,272 A 8/1999 Feldman
5,962,159 A 10/1999 Satou et al.
5,970,545 A 10/1999 Garman et al.
6,008,598 A 12/1999 Luff et al.
6,032,080 A 2/2000 Brisbane et al.
6,037,723 A 3/2000 Shafer et al.
6,073,289 A 6/2000 Bolden et al.
6,085,555 A 7/2000 Wu et al.
6,098,000 A 8/2000 Long et al.
6,099,248 A 8/2000 Mumm et al.
6,108,844 A 8/2000 Kraft et al.
6,129,524 A * 10/2000 Woollenweber et al. ..... 417/366
6,164,314 A 12/2000 Saputo et al.
6,206,654 B1 3/2001 Cassidy
6,237,621 B1 5/2001 Chaffee
6,237,653 B1 5/2001 Chaffee
D446,284 S 8/2001 Chaffee
6,287,095 B1 9/2001 Saputo et al.
6,296,459 B1 10/2001 Saputo et al.
6,302,145 B1 10/2001 Ellis et al.
6,332,760 B1 12/2001 Chung
6,397,419 B1 6/2002 Mechache
6,439,264 B1 8/2002 Ellis et al.
6,483,264 B1 11/2002 Shafer et al.
6,530,751 B1 3/2003 Song et al.
6,543,073 B2 4/2003 Wu
6,550,086 B2 4/2003 Boyd
6,565,315 B1 5/2003 Bertels et al.
6,571,412 B1 6/2003 Wu
6,651,283 B1 11/2003 Cook et al.
6,659,737 B2 12/2003 Bader et al.
6,679,686 B2 1/2004 Wang
6,709,246 B2 3/2004 Boyd

(56) References Cited

U.S. PATENT DOCUMENTS

| | | | | |
|---|---|---|---|---|
| 6,719,401 | B2 | 4/2004 | Takahashi | |
| 6,722,306 | B1 | 4/2004 | Wang | |
| 6,733,254 | B1 | 5/2004 | Yen | |
| 6,793,469 | B2 | 9/2004 | Chung | |
| 6,836,914 | B1 | 1/2005 | Tsai | |
| 6,955,527 | B2 | 10/2005 | Yen | |
| 7,025,576 | B2 * | 4/2006 | Chaffee | 417/366 |
| 7,039,972 | B2 * | 5/2006 | Chaffee | 5/706 |
| 7,120,955 | B2 | 10/2006 | Wang | |
| 7,127,762 | B1 | 10/2006 | Lau | |
| 7,152,265 | B2 | 12/2006 | Chung | |
| 7,198,076 | B2 | 4/2007 | Wu | |
| 7,246,394 | B2 | 7/2007 | Wang | |
| 7,284,291 | B2 | 10/2007 | Wang | |
| 7,306,694 | B2 | 12/2007 | Wang | |
| 7,313,837 | B2 | 1/2008 | Wang | |
| 7,334,274 | B2 | 2/2008 | Wang | |
| 7,475,440 | B2 | 1/2009 | Chaffee | |
| 7,644,724 | B2 | 1/2010 | Chaffee | |
| 8,016,572 | B2 * | 9/2011 | Chaffee | 417/366 |
| 8,225,444 | B2 | 7/2012 | Chaffee | |
| 2001/0026763 | A1 | 10/2001 | Chung | |
| 2001/0044969 | A1 | 11/2001 | Chaffee | |
| 2002/0194678 | A1 | 12/2002 | Chung | |
| 2003/0003001 | A1 | 1/2003 | Chaffee | |
| 2003/0024050 | A1 | 2/2003 | Boso et al. | |
| 2003/0028971 | A1 | 2/2003 | Chaffee | |
| 2003/0099560 | A1 | 5/2003 | Wang | |
| 2003/0115000 | A1 | 6/2003 | Bodas | |
| 2003/0192127 | A1 | 10/2003 | Cook et al. | |
| 2003/0205273 | A1 | 11/2003 | Chaffee | |
| 2003/0215340 | A1 | 11/2003 | Chung | |
| 2004/0037717 | A1 | 2/2004 | Wang | |
| 2004/0241014 | A1 | 12/2004 | Yen | |
| 2005/0044634 | A1 | 3/2005 | Wang | |
| 2005/0047923 | A1 | 3/2005 | Li et al. | |
| 2005/0118046 | A1 | 6/2005 | Wang | |
| 2005/0186097 | A1 | 8/2005 | Wang | |
| 2006/0123549 | A1 | 6/2006 | Chaffee | |
| 2006/0143832 | A1 | 7/2006 | Chaffee | |
| 2008/0229508 | A1 | 9/2008 | Chaffee | |
| 2011/0167564 | A1 | 7/2011 | Chaffee | |

FOREIGN PATENT DOCUMENTS

| | | | |
|---|---|---|---|
| DE | 1808122 | | 5/1970 |
| DE | 4413445 | C2 | 2/1996 |
| DE | 29721150 | U1 | 2/1998 |
| GB | 903557 | A | 8/1962 |
| GB | 1381952 | A | 1/1975 |
| JP | S54-24711 | | 1/1979 |
| JP | 58-53965 | | 4/1983 |
| JP | 05-063354 | B2 | 3/1993 |
| JP | 05137809 | A | 6/1993 |
| JP | 405137809 | A | 6/1993 |
| JP | 0714273 | | 3/1995 |
| JP | H8-93683 | | 4/1996 |
| JP | H11-782439 | | 7/1999 |
| JP | 3023725 | B2 | 3/2000 |
| JP | 2001523322 | A | 11/2001 |
| JP | 3267013 | B2 | 3/2002 |
| WO | 9305684 | A1 | 4/1993 |
| WO | 9803810 | A1 | 1/1998 |
| WO | 0040882 | A1 | 7/2000 |
| WO | 0187121 | A2 | 11/2001 |
| WO | 03093709 | A1 | 11/2003 |

OTHER PUBLICATIONS

Image of Aero product—inflatable bed; Approx. 2002.

Imaginair Aero Product Catalog, 2000 Imaginair Incorporated, Wauconda, IL, USA.

Imaginair by aero, Instruction Manual, Dec. 1999, Imaginair Incorporated, Wauconda, IL, USA.

International Search Report for International Application No. PCT/US02/10073 mailed Jul. 31, 2002, 2 pages.

International Search Report for PCT International Application No. PCT/US02/21756.

International Search Report for PCT International Application No. PCT/US03/14116.

International Search Report for PCT International Application No. PCT/US03/37230.

Supreme Fast-Fill, 2000 Intex Recreation Corpl, Long Beach, CA, USA.

International Search Report from corresponding International Application No. PCT/US01/15834, filed May 17, 2001.

Notification of the First Office Action for Japanese Patent Application No. 2011-27349 mailed Oct. 23, 2012, 5 pages.

Patent Examination Report for Canadian Application No. 2,735,313 dated Apr. 23, 2013, 3 pages.

Final Rejection issued May 14, 2013 for Japanese Application No. 2011-027349, 2 pages.

* cited by examiner

PUMP WITH AXIAL CONDUIT

CROSS REFERENCE TO RELATED APPLICATIONS

This application is a continuation and claims priority under 35 U.S.C. §120 to commonly-owned, co-pending U.S. patent application Ser. No. 10/113,836, filed Apr. 1, 2002 which claims priority under 35 U.S.C. §119(e), to U.S. Provisional patent application Nos. 60/280,257 and 60/280,040, both filed on Mar. 30, 2001, and is a Continuation-In-Part of U.S. patent application Ser. No. 09/859,706, filed May 17, 2001, and is a Continuation-In-Part of International PCT Application No. US01/15834, filed May 17, 2001, the contents of which are all hereby incorporated herein by reference in their entirety.

BACKGROUND

1. Field of the Invention

The present invention is related to pumps and, more specifically, to pumps for use with inflatable devices.

2. Related Art

A variety of methods of providing air or other fluids to inflatable devices have been proposed. Typically a pump is used to supply air to an orifice in the inflatable device. Such pumps may include a motor that drives an impeller, moving the air into the inflatable device. Motorized pumps may be powered by electricity. Typically, such electricity is provided by a connection to standard house current or, where portability is desired, by batteries.

SUMMARY

In one aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing, and a plurality of vanes are positioned within the air conduit.

According to one embodiment, the air conduit is located annularly about an axis of the pump. In another embodiment, the pump includes an impeller which is located outside the air conduit defined between the inner housing and the outer housing.

In a further embodiment, the inflatable device includes an inflatable bladder, the pump is adapted to engage with a valve assembly, and a majority of the pump and a majority of the valve assembly are positioned within a profile of the inflatable bladder when the pump is engaged with the valve assembly.

In another aspect, a pump for moving air includes an inlet, an outlet, an outer housing adapted to couple to an inflatable device, and an inner housing located within the to outer housing. An air conduit is defined between the inner housing and the outer housing. A motor is at least partly positioned within the inner housing and a vane is positioned within the air conduit. The air conduit is located annularly about an axis of the pump for a majority of a distance between the inlet and the outlet.

BRIEF DESCRIPTION OF DRAWINGS

The foregoing and other advantages of the present invention will be more fully appreciated with reference to the following drawings in which.

DETAILED DESCRIPTION

Figure 1:
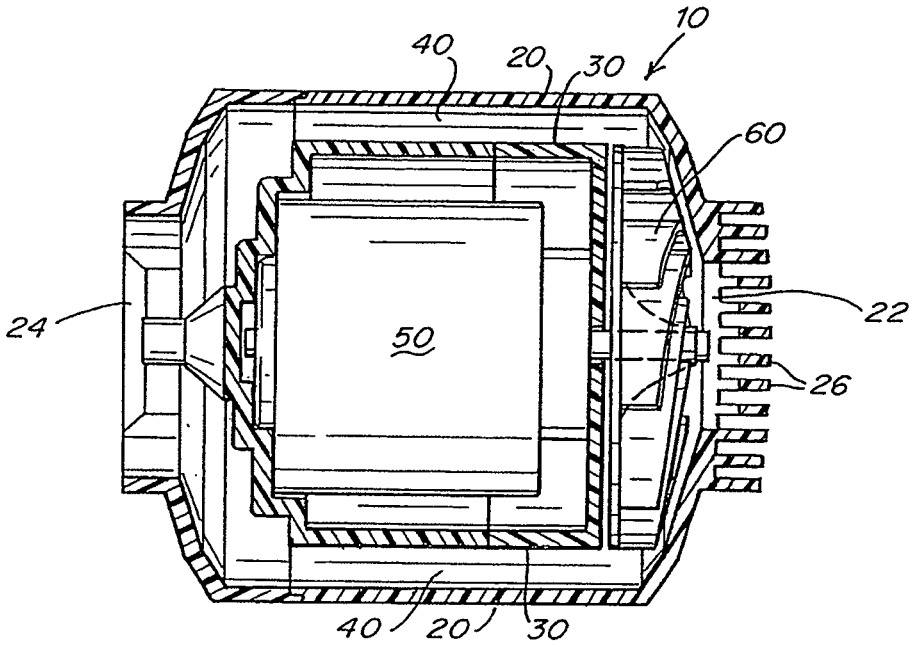
FIG. 1 is a cross-sectional, elevational view of a pump according to one embodiment of the present invention.
Figure 2:
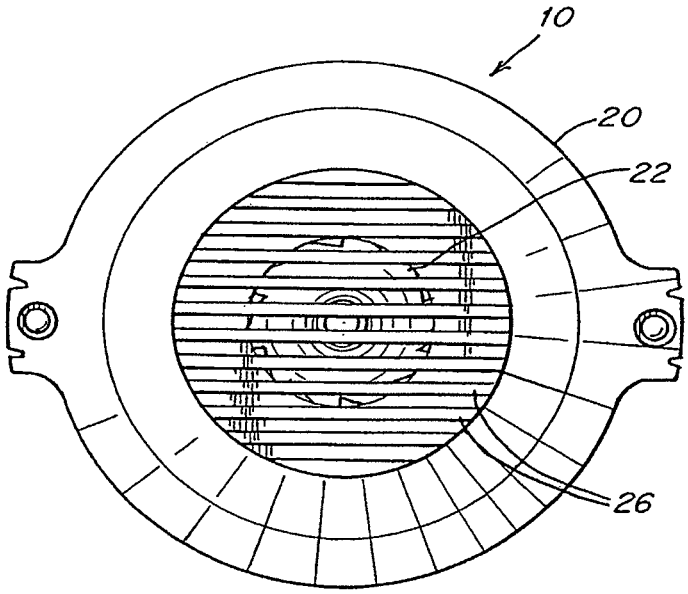
FIG. 2 is an axial, elevational view of the pump of FIG. 1.

The present invention is directed to a pump with an axial fluid conduit. In one embodiment, the pump of the present invention may include an outer housing and an inner housing positioned within the outer housing. The axial fluid conduit may be defined between the inner housing and the outer housing. A motor may be positioned within the inner housing and an impeller positioned within the fluid conduit and connected to the motor.

Referring now to the figures, and, in particular, to FIGS. 1-2 and 5-6, one embodiment will be described. In this embodiment, the pump 10 may include an outer housing 20 and an inner housing 30 positioned within outer housing 20. A fluid conduit 40 may be defined between outer housing 20 and inner housing 30. A motor 50 may be positioned within inner housing 30 and an impeller 60 positioned within fluid conduit 40 and connected to motor 50. The connection may be any attachment known to those of skill in the art.

Outer housing 20 may be constructed in any manner and of any material(s) that render pump 10 sufficiently durable for its intended application and provide a suitable outer wall for fluid conduit 40. For example, outer housing 20 may be constructed of a lightweight, inexpensive, durable, and fluid-tight material. Outer housing 20 may also be shaped such that it is not cumbersome. For example, outer housing 20 may be ergonomically designed. Materials for construction of outer housing 20 include a wide variety of relatively rigid thermoplastics, such as polyvinyl chloride (PVC) or acrylonitrile-butadiene-sytrene (ABS). However, outer housing 20 may also be constructed of other materials, such as metals, metal alloys, and the like.

Outer housing 20 may be constructed in any shape capable of containing an inner housing 30. For example, outer housing 20 may be constructed generally cylindrically. In some embodiments, outer housing 20 may be larger (e.g., have a larger diameter) where it contains inner housing 30, and smaller (e.g., have a smaller diameter) at an inlet 22 and an outlet 24 of outer housing 20. It should be understood that inlet 22 and outlet 24 have been labeled arbitrarily and that fluid can be moved through pump 10 in either direction. For example, pump 10 may be operated in a first direction to push air from inlet 22 to outlet 24 or in a second direction to pull air from outlet 24 to inlet 22.

Inlet 22 may be constructed to facilitate air flow into fluid conduit 40. For example, inlet 22 may be constructed to prevent blockage of inlet 22. In one embodiment, inlet 22 includes protrusions 26 to inhibit blockage of inlet 22. Inlet 22 may also be constructed to prevent foreign objects from contacting impeller 60. For example, inlet 22 may be constructed to have multiple small openings that are relatively difficult for a foreign object, such as a finger, to enter. In a preferred embodiment, protrusions 26 of inlet 22 are constructed as slats, inhibiting foreign objects from contacting impeller 60.

Outlet 24 may be constructed to provide fluid to a desired location. For example, outlet 24 may be constructed to provide fluid to an inflatable device. In one embodiment, outlet 24 includes structure to lock to an inlet of an inflatable device and to bias a valve of the inlet to an open position when the pump is moving fluid to the inflatable device. In another embodiment, the pump may include a solenoid to bias open the valve when the to pump is adding fluid to, drawing fluid from, the inflatable device Inner housing 30 may also be constructed in any manner and of any material(s) that are suitable for containment within outer housing 20, for serving as the inner wall of fluid conduit 40 and for containing motor 50. For example, inner housing 30 may be constructed to fit within outer housing 20, so as to provide the fluid conduit 40. In one embodiment, inner housing 30 is constructed such that it is evenly spaced from an inner surface of outer housing 20. The shape of inner housing 30 may be selected to be compatible with the shape of outer housing 20. For example, where outer housing 20 is generally cylindrical, inner housing 30 may also be generally cylindrical.

Inner housing 30 may also be constructed to securely contain motor 50. For example, inner housing 30 may include internal structure to maintain motor 50 in a desired location. Inner housing 30 may include structure to hold motor 50 in a desired location without allowing undesired vibration or noise. In one embodiment, inner housing 30 may also be constructed to contain one or more batteries to provide electrical power to motor 50. Inner housing 30 may be constructed of any material(s) sufficiently durable to contain motor 50 and suitable for use with the fluid to be pumped. For example, inner housing 30 may be constructed out of any of the same materials as outer housing 20 described supra.

Fluid conduit 40 may be defined by the construction of outer housing 20 and inner housing 30. Fluid conduit 40 may provide sufficient space for fluid flow, so as not to create a significant pressure drop. Fluid conduit 40 may also be regular in shape and substantially free of irregularities that may interfere with efficient fluid flow, potentially creating turbulence, noise and pressure loss.

Fluid conduit 40 may include structure to improve the flow of fluid through fluid conduit 40 and enhance pressurization. Improving the flow through fluid conduit 40 may decrease turbulence and generally result in a pump that is quieter and more efficient. Flow is preferably directed such that the fluid is not forced to make any sudden changes in direction. Fluid conduit 40 is generally axial in direction and impeller 60 will generally impart a rotational force on the fluid relative to the axis of fluid conduit 40. Accordingly, any structure included to improve the flow of fluid through fluid conduit 40 is preferably constructed so as to not inhibit the generally axial movement of fluid through fluid conduit 40, and may allow for the rotation of fluid within fluid conduit 40.

Inefficient fluid flow is preferred to be avoided throughout the length of fluid conduit 40. Accordingly, in a preferred embodiment, the pump is provided with structure to improve the flow of fluid through fluid conduit 40 and enhance pressurization, the structure occupying a majority of fluid conduit 40. The structure for improving the fluid flow preferably occupies at least 75% of the length of fluid conduit 40, even more preferably 90% of the length of fluid conduit 40, and most preferably substantially all of the length of fluid conduit 40, improving flow throughout fluid conduit 40. By way of illustration, what is meant by the structure occupies a majority of fluid conduit 40 is that the structure extends at least half way through the length of fluid conduit 40, not that it fills more than half the void space in fluid conduit 40. A structure occupying the majority of fluid conduit 40 is substantially different from an arrangement that simply directs fluid from an impeller into an open fluid conduit because it controls the fluid flow through a greater portion of fluid conduit 40 and thus is better able to improve fluid flow.

Figure 3:
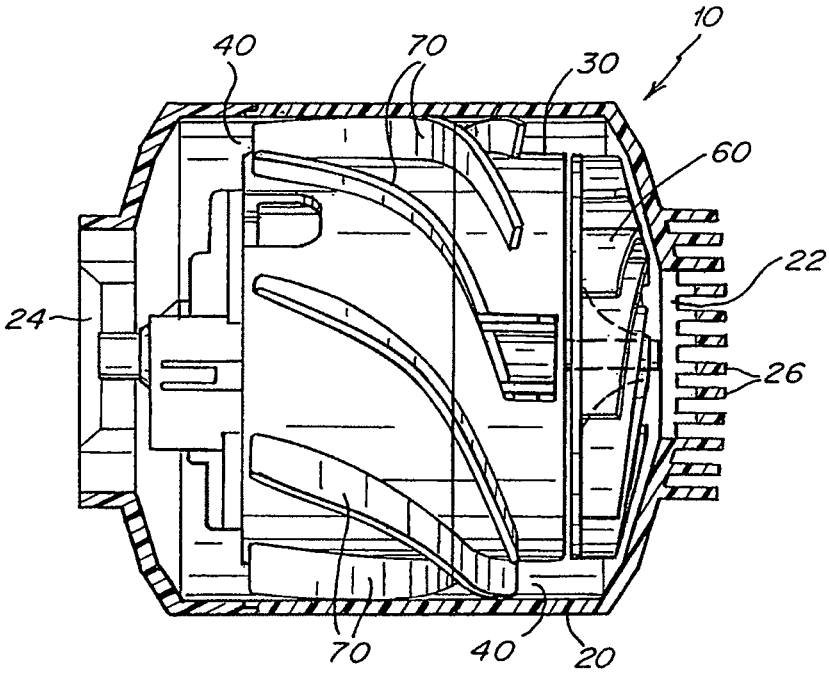
FIG. 3 is a cross-sectional, elevational view of a pump according to another embodiment of the present invention.
Figure 4:
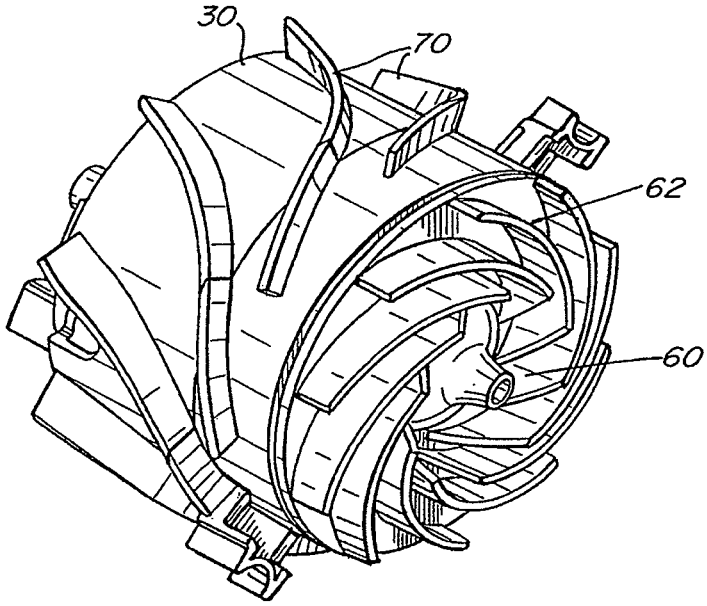
FIG. 4 is a perspective, elevational view of one aspect of the present invention.
Figure 5:
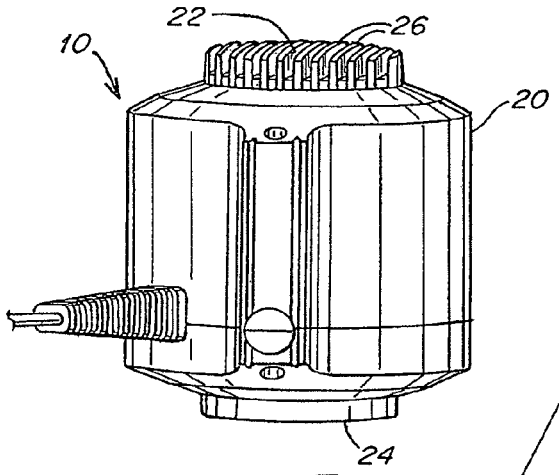
FIG. 5 is a side view of a pump according to one embodiment of the present invention.
Figure 6:
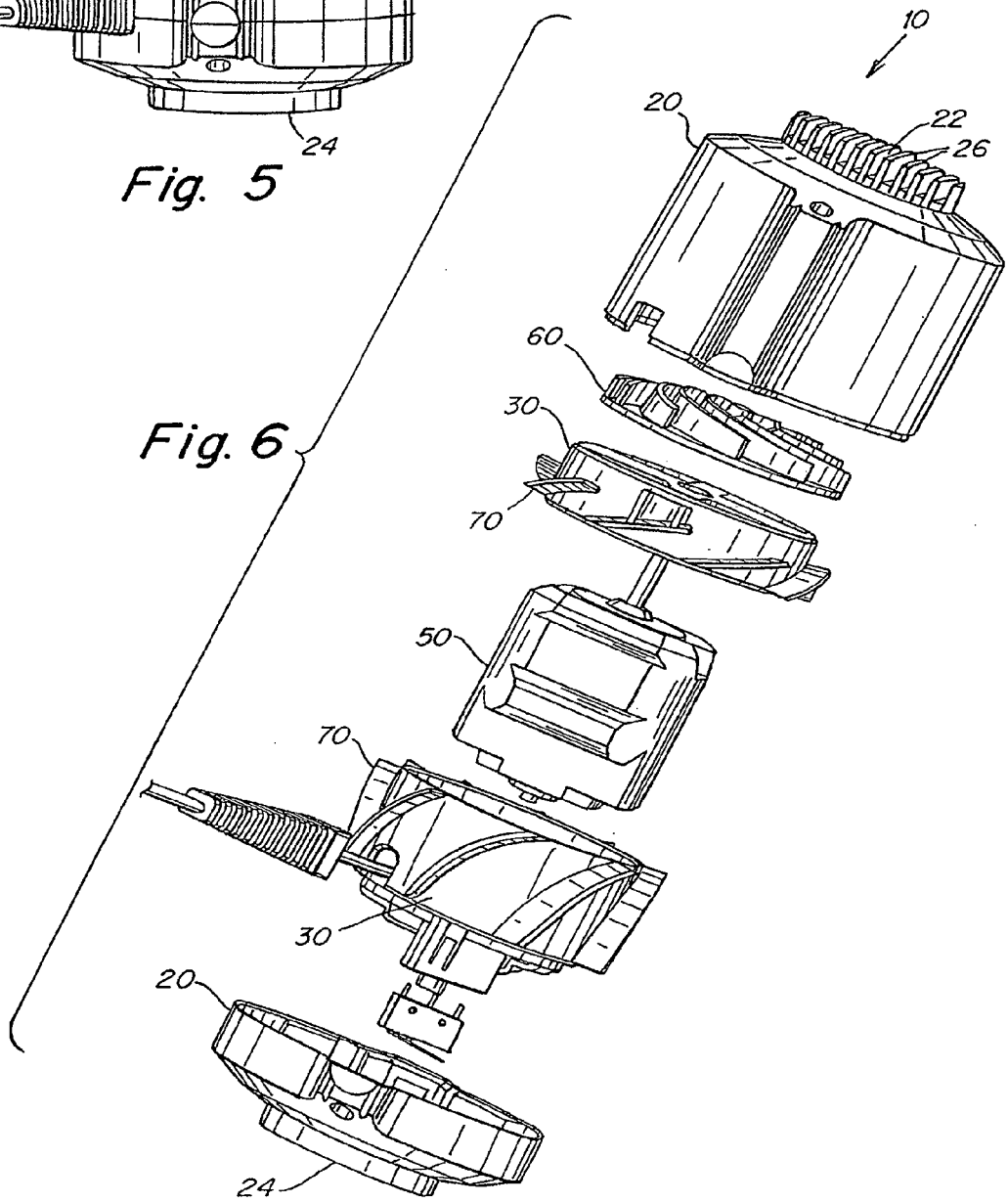
FIG. 6 is an exploded view of the pump of FIG. 6.

In one embodiment, structure to improve the flow of fluid through fluid conduit 40 and enhance pressurization includes one or more structures that direct flow of fluid. For example, referring to FIGS. 3-4 and 6, fluid conduit 40 may include vanes 70 shaped to improve fluid flow through fluid conduit 40. Vanes 70 may be constructed to direct fluid flow within fluid conduit 40 and to bridge fluid conduit 40 from an inner surface of outer housing 20 to an outer surface of inner housing 30, forcing fluid to flow through the channels defined by the vanes. However, it should be understood that vanes 70 need not extend between the inner surface of outer housing 20 and the outer surface of inner housing 30 in all embodiments, or throughout the entire fluid conduit in such embodiments where they do so extend.

Vanes 70 may be constructed to minimize any abrupt changes in fluid flow associated with inefficient flow and increased pressure drop. For example, vanes 70 may be swept in a direction of the rotation imparted by impeller 60, and may direct the flow generally axially along fluid conduit 40. As illustrated, in one embodiment, vanes 70 straighten along the length of fluid conduit 40, allowing them to gradually redirect the air from primarily rotational movement to primarily axial movement. Vanes 70 are preferably free of any rough edges or dead end pockets that may increase fluid resistance.

It should be appreciated that structure to improve the flow of fluid through fluid conduit 40 and enhance pressurization may be particularly useful where fluid conduit 40 is relatively narrow. For example, where it is desired to make pump 10 portable, yet powerful, it may be desired to make inner housing 30 relatively large to house a larger motor, while making outer housing 20 relatively small to reduce the overall size of the device. In such an embodiment, fluid conduit 40 may be relatively narrow. For example, the average distance between an inner surface of outer housing 20 to an outer surface of inner housing 30 may preferably be about 25%, more preferably about 10%, even more preferably about 5%, or less of the average diameter of outer housing 20. In the illustrated embodiment, the average distance between the inner surface of outer housing 20 to the outer surface of inner housing 30 is about 8% of the average diameter of outer housing 20. The narrowness of fluid conduit 40 may itself act as a structure to improve the flow of fluid, directing it axially along the fluid conduit, rather than allowing it to enter a relatively open area. Accordingly, a narrow fluid conduit may be sufficient is some embodiments to reduce inefficient flow.

Fluid conduit 40 may also include structure to maintain the shape of fluid conduit 40. For example, fluid conduit 40 may include structure to secure inner housing 30 relative to outer housing 20. In one embodiment, this structure may include one or more struts connecting an inner surface of outer housing 20 to the outer surface of inner housing 30. In another embodiment, one or more vanes 70 serve to both direct the fluid flow and maintain the relationship between the inner and outer housings.

Motor 50 may be any device capable of rotating impeller 60 to produce fluid flow through pump 10. For example, motor 50 may be a conventional electric motor. In one embodiment, motor 50 is preferably an efficient, lightweight motor. Motor 50 may also be relatively small, to reduce the overall size of pump 10. However, it is to be appreciated that even for a small overall size pump, the motor may still be relatively large compared to the overall size of the pump where it is desired to provide more pumping power.

Impeller 60 may be constructed in any manner and of any material(s) that allow impeller 60 to move fluid when rotated by motor 50. For example, impeller 60 may be constructed with fins 62 capable of forcing fluid into or out of pump 10, depending on the direction of rotation of impeller 60. Impeller 60 may be made of any material capable of maintaining a desired shape of impeller 60. For example, impeller 60 may be constructed of durable and lightweight material that is compatible with the fluid to be used in pump 10. For example, impeller 60 may be constructed of a thermoplastic, such as those mentioned to for use in construction of outer housing 20.

Figure 7:
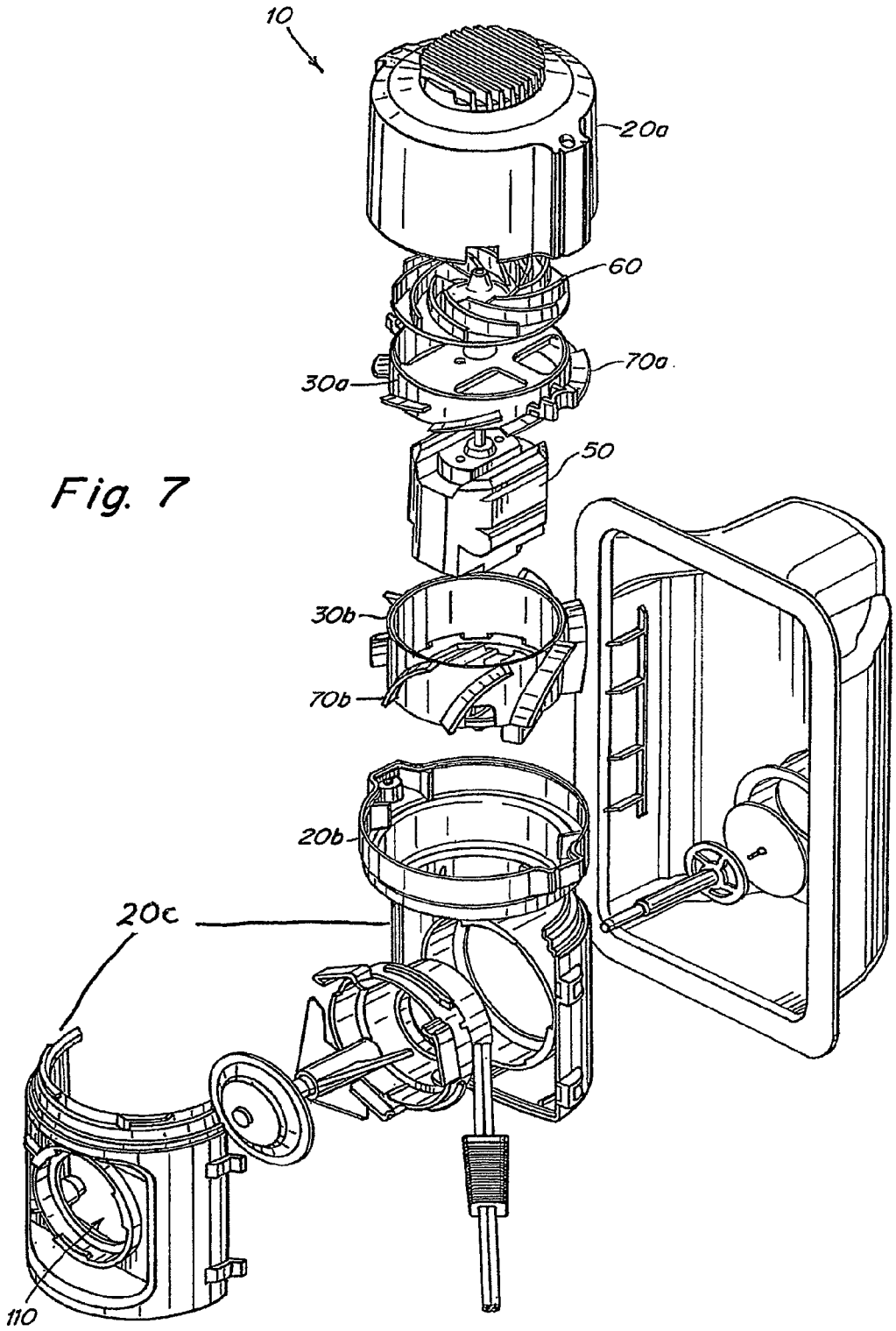
FIG. 7 is an exploded view of one aspect of the present invention.
Figure 8:
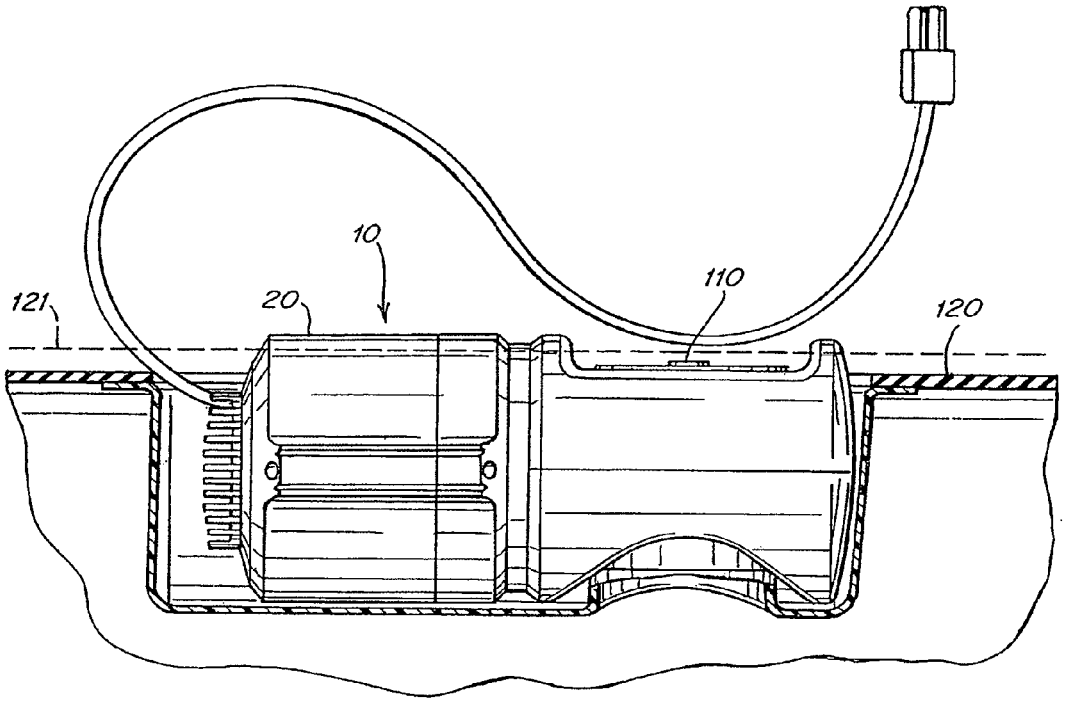
FIG. 8 is a cut-away view of the aspect of FIG. 7.
Figure 9:
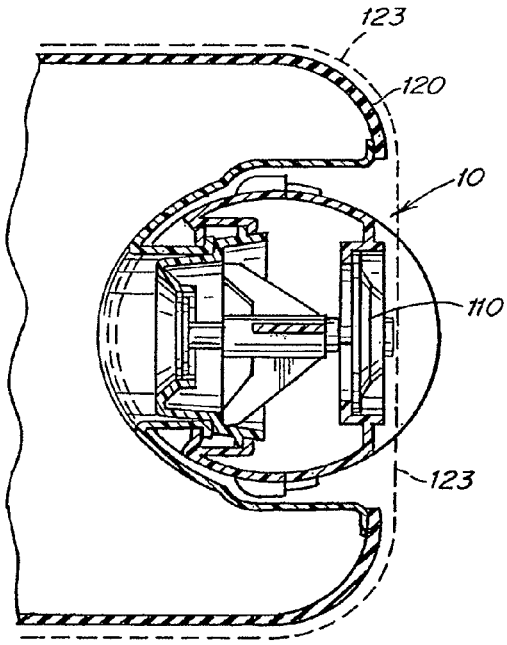
FIG. 9 is a cross-sectional view of the aspect of FIG. 7.

Referring to FIGS. 7-9, according to the present invention pump 10 may be used in a variety of ways. For example, pump 10 may be an independent device, such as a hand holdable pump, and may be placed in contact or connected with an inflatable device when it is desired to inflate the device, typically at a valve 110. In another embodiment, pump 10 may be incorporated into the inflatable device, detachably or permanently. One example embodiment of a pump 10 according to the present invention will now be described with reference to FIGS. 7-9.

In the example embodiment, pump 10 may be connected to a substantially fluid impermeable bladder 120 in an inflatable device. Where pump 10 is connected to bladder 120, pump 10 may be configured so that it does not interfere with the use of the inflatable device. For example the inflatable device may be constructed with pump 10 recessed into bladder 120, as illustrated in FIGS. 7-9. Where pump 10 is recessed within bladder 120, it is an advantage of this embodiment that pump 10 will not interfere with the use of the inflatable device. For example, the exterior profile (total volume and shape) of pump 10 and the inflated device in combination may be substantially the same as the exterior profile of the inflated device absent the combination, thus reducing the opportunity for pump 10 to impact or interfere with the use of the inflatable device. For example, where pump 10 is located within bladder 120 in a mattress application, it allows an inflatable standard sized mattress to fit into a standard sized bed frame. Where pump 10 is located within bladder 120, it may be sized such that it will not come into contact with bladder 120 when bladder 120 is inflated, except at the point(s) of connection. Accordingly, the pump of the present invention, which may be constructed so as to be small and hand-holdable, may be useful in such an application. For additional information regarding incorporating pumps at least partially within a bladder, see U.S. patent application Ser. No. 09/859,706, which is hereby incorporated by reference in its entirety.

An embedded pump 10 may be powered by conventional household current or by battery power. It should also be understood that pump 10 can be a hand holdable pump that is detachable from the inflatable device and is configured to mate with the inflatable device and to be embedded substantially within the bladder.

Outer housing (comprising multiple portions 20*a*, 20*b* and 20*c*) may house other structure in addition to inner housing (comprising two portions 30*a* and 30*b*, and corresponding vanes comprising two portions 70*a* and 70*b*) and motor 50. For example, outer housing may include fluid control structure such as valves. Valves may be operated manually, by using a solenoid, or using other conventional techniques. The structure to operate the valve may also be included within outer housing. For example, the outer housing can include portions 20*a*, 20*b* and 20*c*, where the portion 20*c* includes structure to operate the valve.

Figure 10:
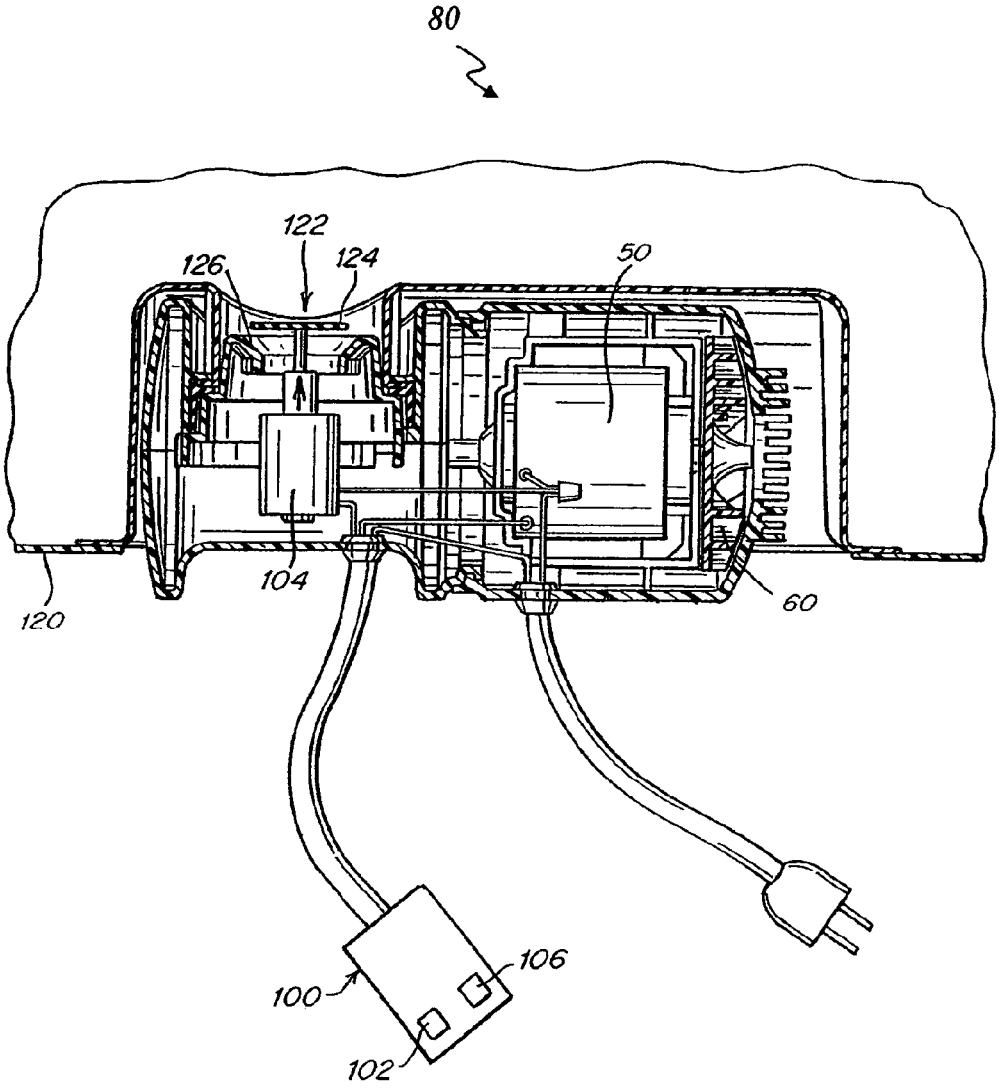
FIG. 10 is a cross-sectional, elevation view of a fluid controller according to an embodiment of the present invention.

FIG. 10 illustrates a cross-sectional, elevation view of a fluid controller 80. According to one embodiment, the fluid controller 80 includes a pump which may be constructed in any manner and using any materials that allows fluid controller 80 to control the flow of fluid into and/or out of bladder 120. In one embodiment, fluid controller 80 may be constructed in any manner and using any materials that allow it to inflate and/or deflate bladder 120. For example, as illustrated in FIG. 10, the pump may be a conventional fluid pump including a motor 50 that drives an impeller 60 moving air into, or out of, bladder 120. Where the pump includes motor 50, motor 50 may be powered by electricity. Electricity may be provided by a connection to standard house current or, where portability is desired, by batteries. Other types of pumps, such as diaphragm pumps, may also be used so long as they allow the pump to inflate bladder 120 to within a desired pressure range, which may include a pressure range that can be adjusted by, for example, another fluid pumping device, such as someone blowing into a conventional valve stem within the bladder, a foot pump, and the like.

Fluid controller 80 may be operated by any conventional control mechanism, such a conventional power switch. Fluid controller 80 may also include a structure for controlling fluid controller 80, such an adjustment device 100. Adjustment device 100 may be separate or separable from fluid controller 80 to allow fluid controller 80 to be controlled remotely. In one embodiment, adjustment device 100 is a hand-held device for controlling fluid controller 80.

Adjustment device 100 may include structure for controlling the operation of pump. For example, adjustment device 100 may include a conventional power switch 102 that energizes and de-energizes pump. Switch 102 may be any of the many well-known mechanisms for selectively connecting two conductors to supply electricity to a point of use. Switch 102 may allow pump to be energized such that it inflates bladder 120. Adjustment device 100 may also include structure that directs the deflation of bladder 120. For example, a second switch may reverse the direction of pump to deflate bladder 120. In some embodiments, pump may incorporate a valve which must be opened to allow deflation of bladder 120. In these embodiments, adjustment device 100 may also include structure to mechanically or electro-mechanically open a valve to allow deflation of bladder 120. For example, a switch 106 may act upon a mechanical opening mechanism or activate a solenoid 104 to open a valve, such as valve 122, and allow deflation of bladder 120. In one embodiment, the valve that is opened is a self-sealing valve, meaning that it is held closed, at least in part, by pressure within bladder 120. For example, a self sealing valve may include a diaphragm 124 that is urged against a valve seat 126 by fluid pressure from within bladder 120. Optionally, switch 106 may also energize the pump to withdraw fluid from bladder 120.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed is:

1. An inflatable device comprising:

a fluid controller including:

a valve assembly including a valve, the valve including a self-sealing diaphragm assembly;

a pump for moving air, the pump fluidly coupled to the valve and including:

a housing including an inlet configured to fluidly couple the pump to ambient, an outlet fluidly coupled to the valve and an air conduit between the inlet and the outlet;

an electromechanical device configured to act on the self-sealing diaphragm assembly to open the valve;

a motor and an impeller located within the housing configured for moving air from the inlet through the air conduit to the outlet; and wherein the valve is configured to fluidly couple the pump to the inflatable device, wherein the inflatable device includes an inflatable bladder, wherein a majority of the pump and the valve assembly are positioned within a profile of the inflatable bladder with the pump coupled to the valve assembly in a mounted position and orientation, and wherein in the same mounted position and orientation of the pump, the fluid controller is configured to electromechanically open the valve via the electromechanical device to permit air to exit the inflatable bladder through the fluid controller and is also configured to energize the pump to provide air to the inflatable bladder through the pump and the valve.

2. The inflatable device of claim 1, further comprising at least one vane positioned within the air conduit, wherein the at least one vane includes a sweep.

3. The inflatable device of claim 1, wherein the pump includes an axis, wherein the pump moves air through the air conduit parallel to the axis, and wherein the at least one vane is adapted to provide a substantially linear air flow.

4. The inflatable device of claim 1, wherein the pump is sized and configured to be hand held to allow a user to detachably connect the pump to the inflatable device.

5. The inflatable device of claim 1, wherein an axis of the pump is perpendicular to an axis of the valve assembly when the pump is coupled to the valve assembly.

6. An inflatable device comprising:

a fluid controller including:

a valve assembly including a valve, the valve including a self-sealing diaphragm assembly;

an electromechanical device configured to act on the self-sealing diaphragm assembly to open the valve;

a pump for moving air, the pump fluidly coupled to the valve and including:

a housing including an inlet configured to fluidly couple the pump to ambient, an outlet fluidly coupled to the valve an air conduit between the inlet and the outlet;

a motor and an impeller located within the housing configured for moving air from the inlet through the air conduit to the outlet; and a vane positioned within the air conduit, wherein the valve is configured to fluidly couple the pump to the inflatable device, wherein the inflatable device includes an inflatable bladder;

wherein a majority of the pump and the valve assembly are positioned within a profile of the inflatable bladder with the pump coupled to the valve assembly in a mounted position and orientation, and wherein in the same mounted position and orientation of the pump, the fluid controller is configured to electromechanically open the valve via the electromechanical device to permit air to exit the inflatable bladder through the fluid controller and to energize the pump to provide air to the inflatable bladder through the pump and the valve.

7. The inflatable device of claim 6, wherein the vane has a sweep.

8. The inflatable device of claim 7, wherein the sweep of the vane is configured to gradually redirect fluid flowing through the air conduit from primarily rotational motion to primarily axial motion.

9. The inflatable device of claim 6, wherein the pump is externally accessible when coupled to the valve assembly.

10. The inflatable device of claim 6, wherein the pump is configured to allow a user to detachably connect the pump to the inflatable device.

11. The inflatable device of claim 6, wherein the vanes extend at least 90% of the length of the fluid conduit.

12. The inflatable device of claim 6, wherein the vane includes a plurality of vanes that each extend unbroken for substantially all of their length.

13. The inflatable device of claim 6, wherein at least a portion of the valve assembly is permanently coupled to the inflatable device.

14. The inflatable device of claim 6, wherein the valve is a self sealing valve.

15. The inflatable device of claim 6, further comprising an a housing configured to provide a socket within a profile of the inflatable bladder, and wherein in the mounted position and orientation of the pump, the majority of the pump and the valve assembly are at located in the socket.

16. The inflatable device of claim 15, wherein the socket includes a wall, and wherein the valve assembly is located at least partly within the wall.

17. The inflatable device of claim 6, further comprising a switch electrically connected to the pump and configured to operate the electromechanical opening mechanism.

18. The inflatable device of claim 6, wherein the electromechanical opening mechanism includes a solenoid.

19. An inflatable device comprising:

a fluid controller including:

a valve assembly including a valve, the valve including a self-sealing diaphragm assembly;

an electromechanical device configured to act on the self-sealing diaphragm assembly to open the valve;

a pump for moving air, the pump fluidly coupled to the valve and including:

an outer housing including an inlet configured to fluidly couple the pump to ambient and an outlet fluidly coupled to the valve;

an inner housing located within the outer housing and defining an air conduit between the inner housing and the outer housing;

a motor partially located within the inner housing and an impeller located within the outer housing for moving air from the inlet through the air conduit to the outlet; and a vane positioned within the air conduit;

wherein the valve is configured to fluidly couple the pump to the inflatable device, wherein the inflatable device includes an inflatable bladder, wherein a majority of the pump and the valve assembly are positioned within a profile of the inflatable bladder with the pump coupled to the valve assembly in a mounted position and orientation, and wherein in the same mounted position and orientation of the pump, the fluid controller is configured to electromechanically open the valve via the electromechanical device to permit air to exit the inflatable bladder through the fluid controller and to energize the pump to provide air to the inflatable bladder through the pump and the valve.

* * * * *

UNITED STATES PATENT AND TRADEMARK OFFICE

CERTIFICATE OF CORRECTION

PATENT NO. : 8,776,293 B2
APPLICATION NO. : 13/205271
DATED : July 15, 2014
INVENTOR(S) : Robert B. Chaffee It is certified that error appears in the above-identified patent and that said Letters Patent is hereby corrected as shown below:

In the Specification:

Column 3, Line 13, delete “to” as it appears between “the” and “pump”.

Column 5, Line 17, delete “to”.

Signed and Sealed this
Ninth Day of December, 2014

Michelle K. Lee

Michelle K. Lee
*Deputy Director of the United States Patent and Trademark Office*